US007932865B2

(12) United States Patent
Wong et al.

(10) Patent No.: US 7,932,865 B2
(45) Date of Patent: Apr. 26, 2011

(54) COPLANAR COUPLED-FED MULTIBAND ANTENNA FOR THE MOBILE DEVICE

(75) Inventors: Kin-Lu Wong, Kaohsiung (TW); Chih-Hung Huang, Taipei (TW)

(73) Assignee: Acer Incorporated, Taipei Hsien (TW)

( * ) Notice: Subject to any disclaimer, the term of this patent is extended or adjusted under 35 U.S.C. 154(b) by 315 days.

(21) Appl. No.: 12/232,587

(22) Filed: Sep. 19, 2008

(65) Prior Publication Data

US 2009/0273521 A1 Nov. 5, 2009

(30) Foreign Application Priority Data

May 5, 2008 (TW) ..... 97116539 A

(51) Int. Cl.
*H01Q 1/24* (2006.01)

(52) U.S. Cl. ..... 343/702; 343/700 MS

(58) Field of Classification Search ..... 343/702, 343/700 MS
See application file for complete search history.

(56) References Cited

U.S. PATENT DOCUMENTS

2003/0117325 A1* 6/2003 Jo et al. ..... 343/702
2008/0106478 A1* 5/2008 Hill ..... 343/702

FOREIGN PATENT DOCUMENTS

TW 490884 B 6/2002

* cited by examiner

*Primary Examiner* — Douglas W Owens
*Assistant Examiner* — Dieu Hien T Duong
(74) *Attorney, Agent, or Firm* — Jianq Chyun IP Office

(57) ABSTRACT

The present invention is related to a coplanar coupled-fed multiband antenna for the mobile communication device. The antenna mainly comprises a dielectric substrate, a ground plane located on one surface of the dielectric substrate, and a radiating portion, a shorting metal portion, and a feeding portion, which are all on the same surface of the dielectric substrate near one edge of the ground plane. One end of the shorting metal portion is connected to the radiating portion, and the other end is connected to the ground plane. The feeding portion comprises a first feeding metal portion and a second feeding metal portion. The first feeding metal portion has a feeding point for the antenna. One end of the second feeding metal portion is connected to the radiating portion, and there is a gap between the second feeding metal portion and the first feeding metal portion.

13 Claims, 9 Drawing Sheets

COPLANAR COUPLED-FED MULTIBAND ANTENNA FOR THE MOBILE DEVICE

BACKGROUND OF THE INVENTION

1. Field of the Invention

The present invention is related to a multiband antenna for mobile communication, particularly to a coplanar coupled-fed multiband antenna for mobile communication.

2. Description of the Related Art

With the great development of wireless communication, various wireless communication technologies and products are progressing and appearing constantly. Various mobile phones appear consequently and the original dual-band operation of the mobile phone is improved to multiple-band operation to satisfy the demand for the mobile phones with more communication bands. It is a great challenge for the conventional planar inverted-F antenna to use single resonance path to realize GSM850/900 operation in the lower band with a limited space. For example, Taiwan Patent Publication No. 490,884 of "Dual-band inverted-F patch antenna and the radiating metal sheet" disclosed an inverted-F patch antenna to realize the dual-band operation. However, the lower band of such an antenna can cover GSM900 operation only.

To solve the said problem, we provide a design of the coupled-fed antenna for multiband mobile communication device to cover GSM850 (824~894 MHz), GSM900 (890~960 MHz), DCS (1710~1880 MHz), PCS (1850~1990 MHz) and UMTS (1920~2170 MHz) operations. This design is a single antenna having a dual-resonance characteristic to realize the wideband operation, and the lower band is obtained by mainly using a coplanar coupling feed to reduce the inductive reactance of the antenna, thereby the former single resonance mode in the lower band can achieve the dual-resonance characteristic to cover GSM850/900 operation. Besides, the structure of the antenna is simple and easily printed or etched on a surface of the dielectric substrate, thereby making the antenna fabrication at low cost. Therefore, the antenna of the present invention is applicable for mobile communication devices.

SUMMARY OF THE INVENTION

As the aforesaid, one of the objectives of the present invention is to provide a coplanar coupled-fed multiband antenna for mobile communication, which can cover GSM850/900, DCS, PCS and UMTS operations.

The antenna of the present invention comprises a dielectric substrate, a ground plane, a radiating portion, a shorting metal portion and a feeding portion. The ground plane is located on a surface of the dielectric substrate and has a shorting point located at an edge of the ground plane, and the edge is located in the interior of the dielectric substrate. The radiating portion is preferably formed by stamping or cutting a metal sheet, or formed on the surface of the dielectric substrate by printing or etching. The radiating portion is located near an edge of the ground plane, and does not overlap with the ground plane.

The shorting metal portion is formed by stamping or cutting a metal sheet, or formed on the dielectric substrate by printing or etching. The shorting metal portion is located on the same surface with the radiating portion. One end of the shorting metal portion is electrically connected to the radiating portion, and the other end is electrically connected to the shorting point of the ground plane.

The feeding portion is located on a surface of the dielectric substrate where the radiating portion is also located. The feeding portion comprises a first feeding metal portion and a second feeding metal portion. The first feeding metal portion has a feeding point which serves as the feeding point of the antenna and is connected to a signal source. One end of the second feeding metal portion is connected to the radiating portion. The second feeding metal portion is separated from the first feeding metal portion by a gap.

Besides, the feeding portion can comprise a single feeding metal portion which is directly separated from the radiating portion by a gap to capacitively excite the radiating portion.

Preferably, in the antenna of the present invention, the radiating portion further comprises a first metal portion and a second metal portion which both resonate at the ¼-wavelength mode. The first metal portion is used to excite the upper band of the antenna, and the second metal portion is used to excite the lower band. By the coplanar coupling feed, the real-part input impedance of the lower band (¼-wavelength resonant mode of the second metal portion) can be reduced. The gap between the second metal portion and the first metal portion can be adjusted to increase the capacitive reactance effectively, and reduce the inductive reactance of the lower band (¼-wavelength resonant mode of the second metal portion) and additionally increase the zero point of the imaginary-part input impedance near the ¼-wavelength resonant frequency. By adjusting the size of the shorting metal portion properly, good impedance matching can be achieved, and the radiating portion can achieve dual resonance for the lower band to cover the global mobile communication system (GSM850, 824~894 MHz) and (GSM900, 890~960 MHz) required in for WWAN operation. The upper band of the antenna is a wideband mode excited by the first metal portion and covers the digital communication system (DCS, 1710~1880 MHz), personal communication system (PCS, 1850~1990 MHz) and universal mobile telecommunications system (UMTS, 1920~2170 MHz).

BRIEF DESCRIPTION OF THE DRAWINGS

The subject matter regarded as the invention is particularly pointed out and distinctly claimed in the concluding portion of the specification. The invention together with features and advantages thereof may best be understood by reference to the following detailed description with the accompanying drawings in which:

DETAILED DESCRIPTION OF THE PREFERRED EMBODIMENTS

Exemplary embodiments of the present invention are described herein in the context of the coplanar coupled-fed multiband antenna for mobile communication.

Those of ordinary skilled in the art will realize that the following detailed description of the exemplary embodiment (s) is illustrative only and is not intended to be in any way limiting. Other embodiments will readily suggest themselves to such skilled persons having the benefit of this disclosure. Reference will now be made in detail to implementations of the exemplary embodiment(s) as illustrated in the accompanying drawings. The same reference indicators will be used throughout the drawings and the following detailed description to refer to the same or like parts.

Figure 1:
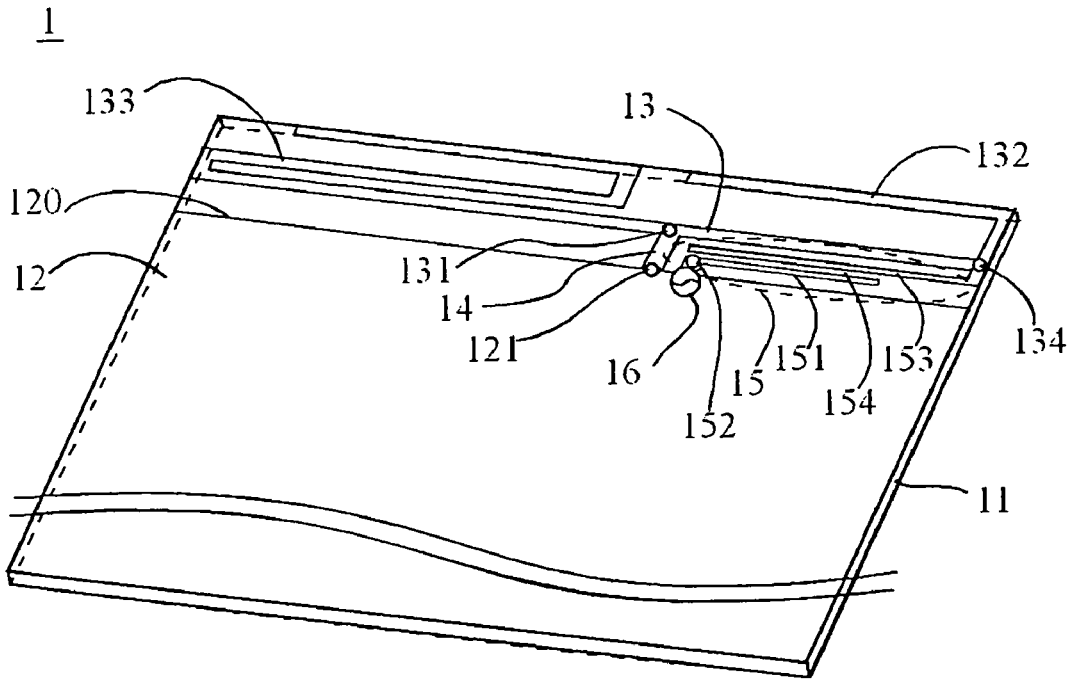
FIG. 1 is a structural drawing of first embodiment of an antenna in the present invention.

FIG. 1 illustrates a structural drawing of first embodiment of an antenna in the present invention. The antenna comprises a dielectric substrate 11, a ground plane 12, a radiating portion 13, a shorting metal portion 14, and a feeding portion 15.

The ground plane 12 is located on a surface of the dielectric substrate, and has is a shorting point 121, which is located at an edge 120 of the ground plane 12. The edge 120 is located in the interior of the dielectric substrate 11. The radiating portion 13 is formed by stamping or cutting a metal sheet, or the radiating portion 13 can also be formed on the dielectric substrate 11 by printing or etching and located on a surface of the dielectric substrate 11, and the radiating portion 13 is located near the edge 120 of the ground plane 12 and does not overlap with the ground plane 12. The radiating portion 13 further comprises a first metal portion 132 and a second metal portion 133.

The first metal portion 132 has at least one bending. The second metal portion 133 has at least one bending and is connected to the first metal portion 132. The shorting metal portion 14 is formed by stamping or cutting a metal sheet as the radiating portion 13, or can also be formed on the dielectric substrate 11 by printing or etching. The shorting metal portion 14 is located on the surface the dielectric substrate 11 where the radiating portion 13 is also located on. One end of the shorting metal portion 14 is electrically connected to the radiating portion 13, and the other end of the shorting metal portion 14 is electrically connected to the shorting point 121 of the ground plane 12. The feeding portion 15 can be formed on the dielectric substrate 11 by printing or etching, and located on the surface of the dielectric substrate 11 where the radiating portion 13 is also located on.

The feeding portion 15 comprises a first feeding metal portion 151 and a second feeding metal portion 153. The first feeding metal portion 151 has a feeding point 152 which serves as the feeding point 152 of the antenna of the present invention. The feeding point 152 is connected to a signal source 16. One end of the second feeding metal portion 153 is connected to the radiating portion 13, and the second feeding metal portion 153 is separated from first feeding metal portion 151 by a gap 154.

Figure 2:
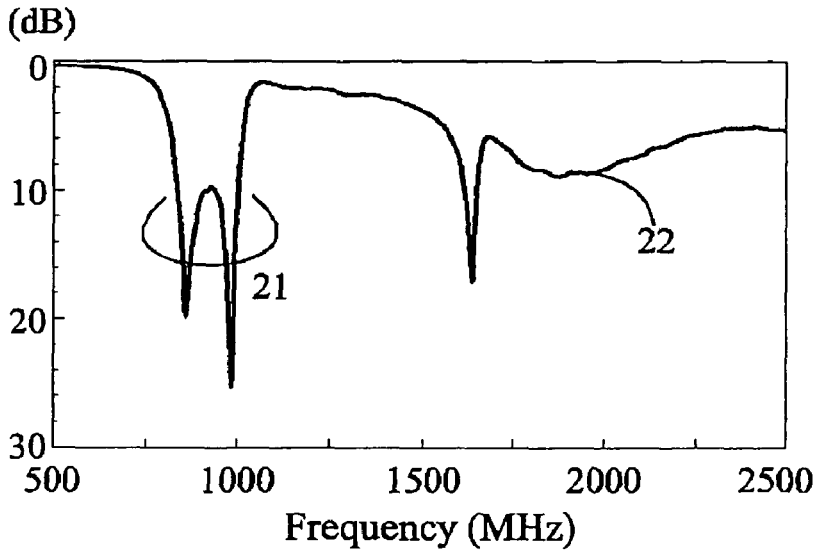
FIG. 2 is a result of return loss measurement of first embodiment of an antenna of the present invention.
Figure 3:
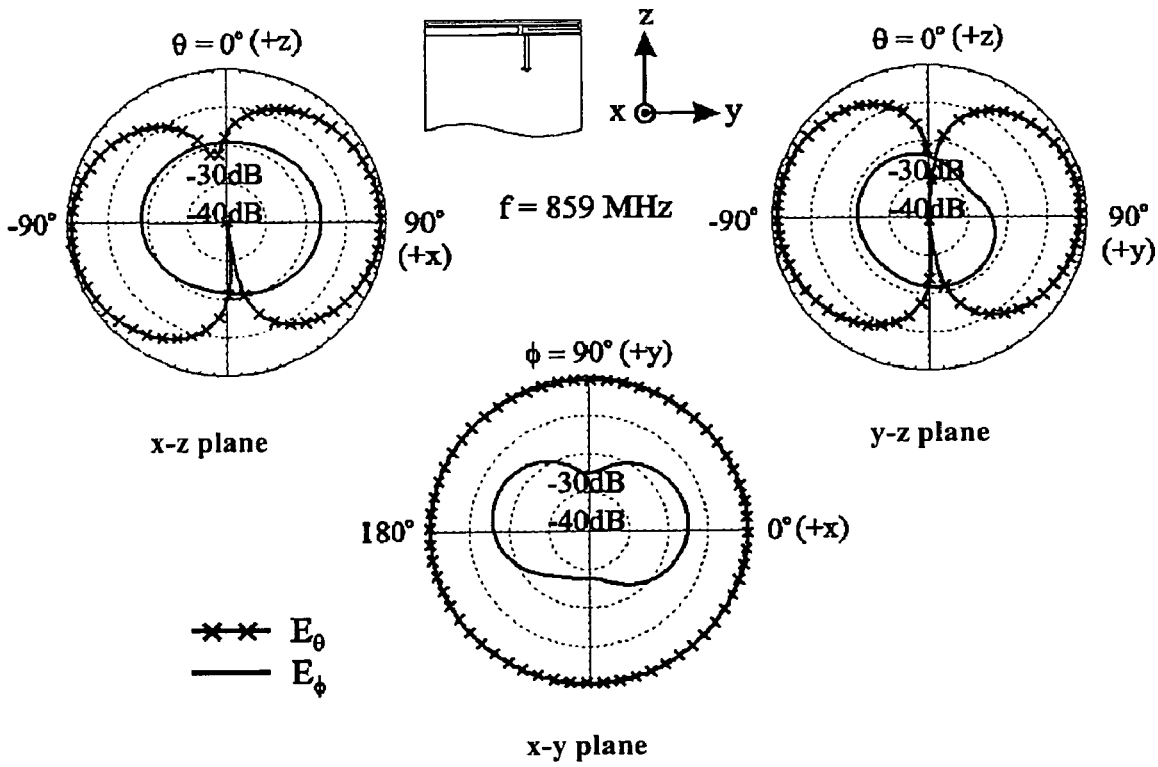
FIG. 3 is a radiation pattern at 859 MHz of first embodiment of an antenna of the present invention.
Figure 4:
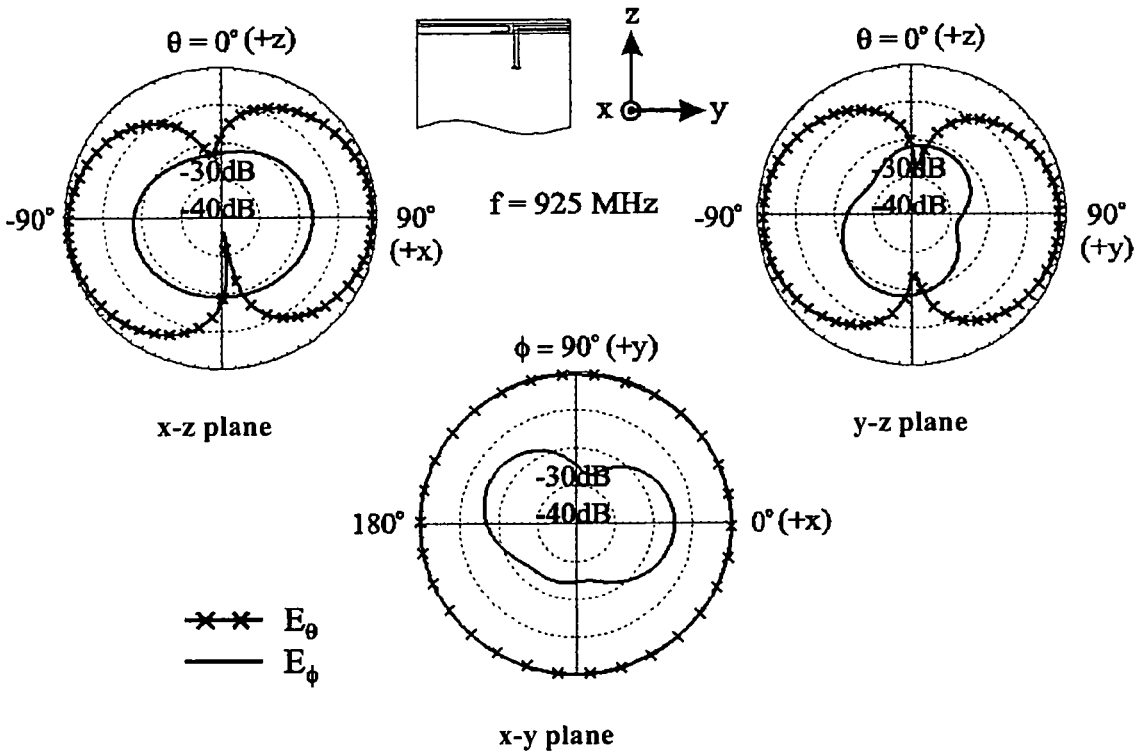
FIG. 4 is a radiation pattern at 925 MHz of first embodiment of an antenna of the present invention.
Figure 5:
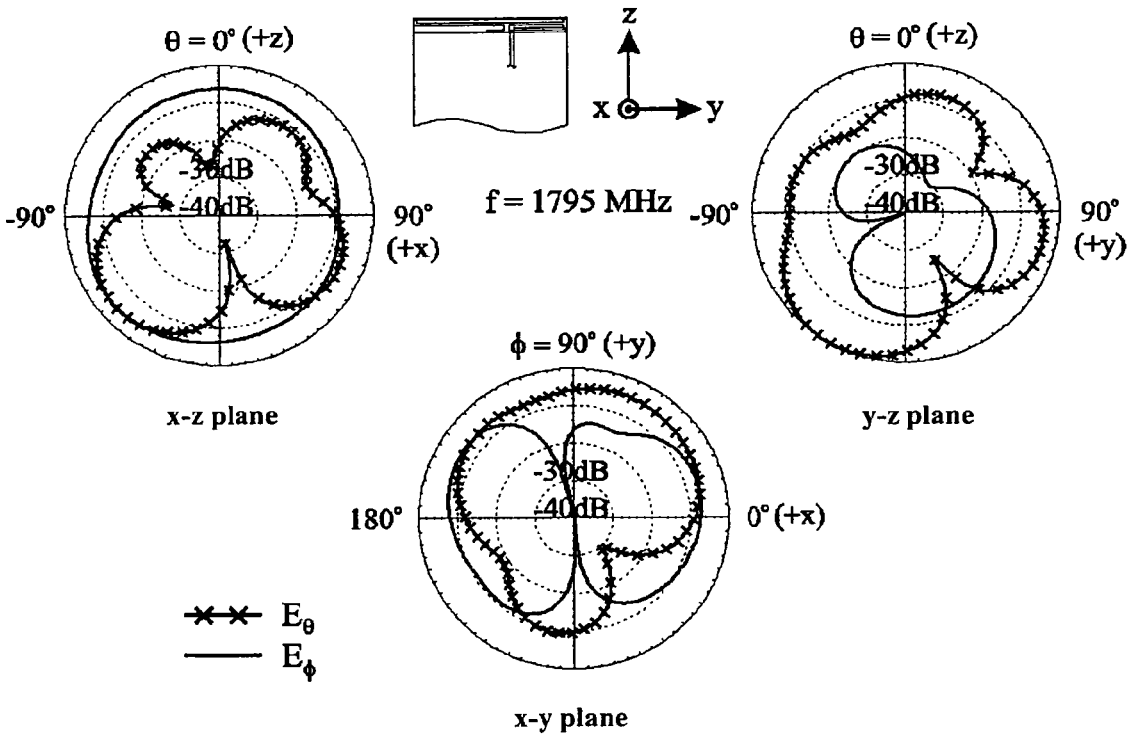
FIG. 5 is a radiation pattern at 1795 MHz of first embodiment of an antenna of the present invention.
Figure 6:
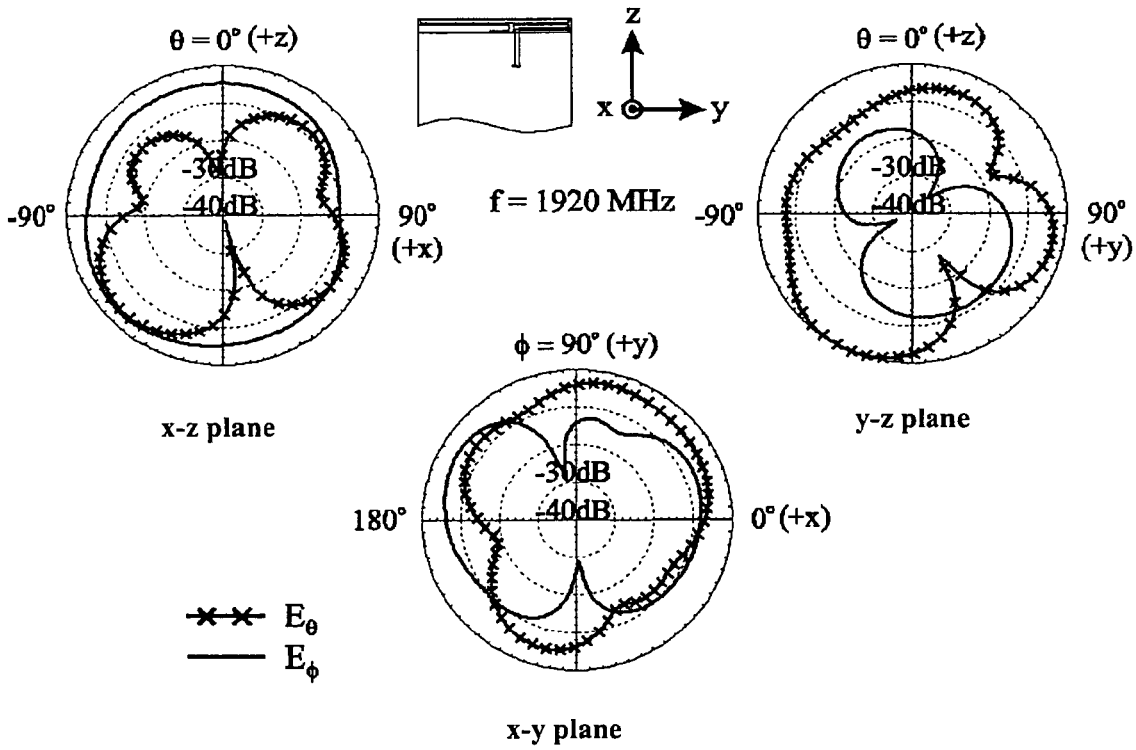
FIG. 6 is a radiation pattern at 1920 MHz of first embodiment of an antenna of the present invention.
Figure 7:
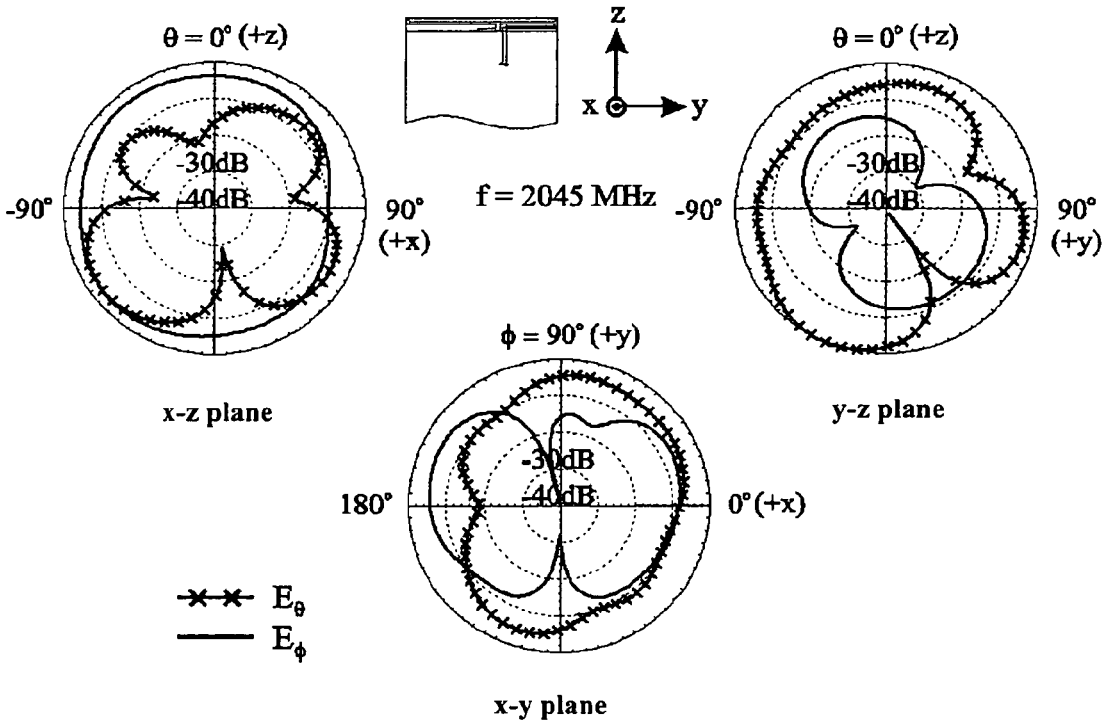
FIG. 7 is a radiation pattern at 2045 MHz of first embodiment of an antenna of the present invention.

FIG. 2 is a result of return loss measurement of first embodiment of an antenna of the present invention. In first embodiment, the following sizes of the elements of the antenna are selected for the experiment: the length the width of the dielectric substrate 11 are about 110 mm and 60 mm, respectively; the length and the width of the ground plane 12 is about 100 mm and 60 mm, respectively. In the radiation portion 13, the length of the first metal portion 132 is about 40 mm, which is about ¼ wavelength at 1900 MHz, and the width of the first metal portion 132 is about 1 mm. The length of the second metal portion 133 is about 83 mm which is about ¼ wavelength at 900 MHz, and the width of the second metal portion 133 is about 1 mm. The length of the shorting metal portion 14 is about 3 mm, and the width of the shorting metal portion 14 is about 1 mm. In the feeding portion 15, the length and the width of the first feeding metal portion 151 are about 22 mm and 0.3 mm, respectively; the length and the width of the second feeding metal portion 153 are about 20 mm and 0.6 mm, respectively. The gap 154 between the second feeding metal portion 153 and the first feeding metal portion 151 is about 1.0 mm. According to the definition of 6 dB return loss, experimental result shows that the lower band 21 is sufficient to cover GSM850/900 operation, and the upper band 22 covers DCS/PCS/UMTS operation. Besides, the width of the gap 154 can be extended to 3 mm, and other related sizes of the feeding portion 15 are adjusted accordingly; in this case, we can achieve a result similar to FIG. 2.

FIG. 3, FIG. 4, FIG. 5, FIG. 6, and FIG. 7 illustrate the radiating patterns at 859 MHz, 925 MHz, 1795 MHz, 1920 MHz, and 2045 MHz of first embodiment of the present invention, respectively. The antenna gains are respectively 1.20, 1.97, 2.29, 2.64 and 2.02 dBi. According to the result, both the lower band and upper band of the antenna of the present invention can satisfy the requirements for mobile communication.

Figure 8:
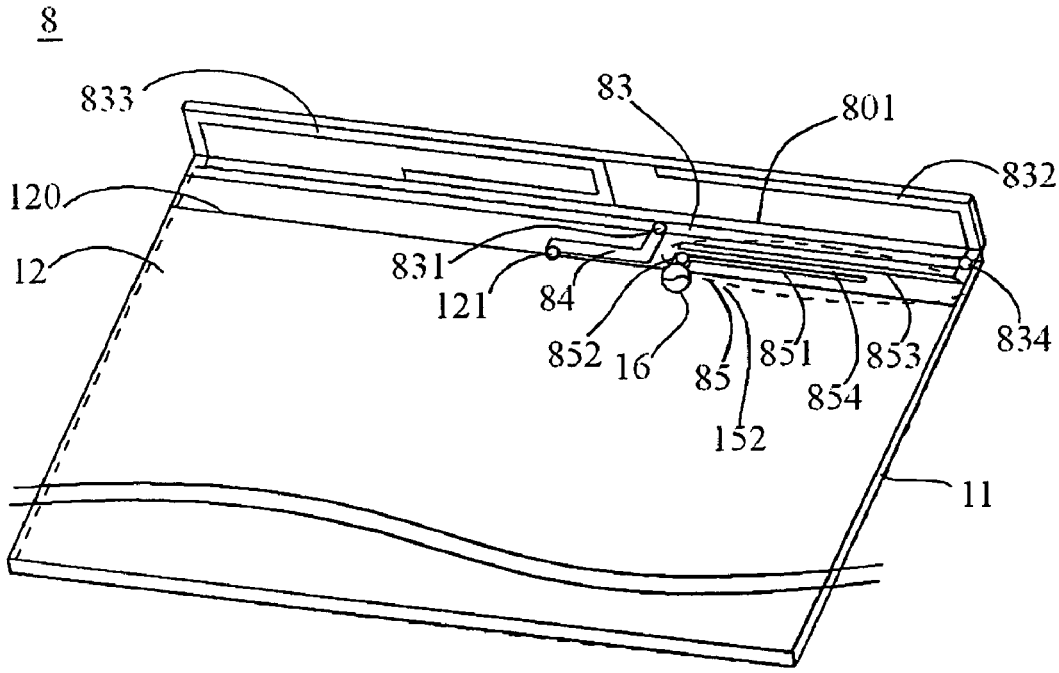
FIG. 8 is a structural drawing of the second embodiment of an antenna of the present invention.

FIG. 8 is a structural drawing of the second embodiment of an antenna of the present invention. The radiating portion 13 has at least one bending 801 so that a part of the radiating portion 13 can be roughly vertical with the ground plane, thereby the space required for embedding the antenna in the mobile communication device can be reduced. The structures of other elements of the antenna of this embodiment are similar to first embodiment. In this embodiment, we can also obtain a result similar to first embodiment, which satisfies the requirements for mobile communication.

Figure 9:
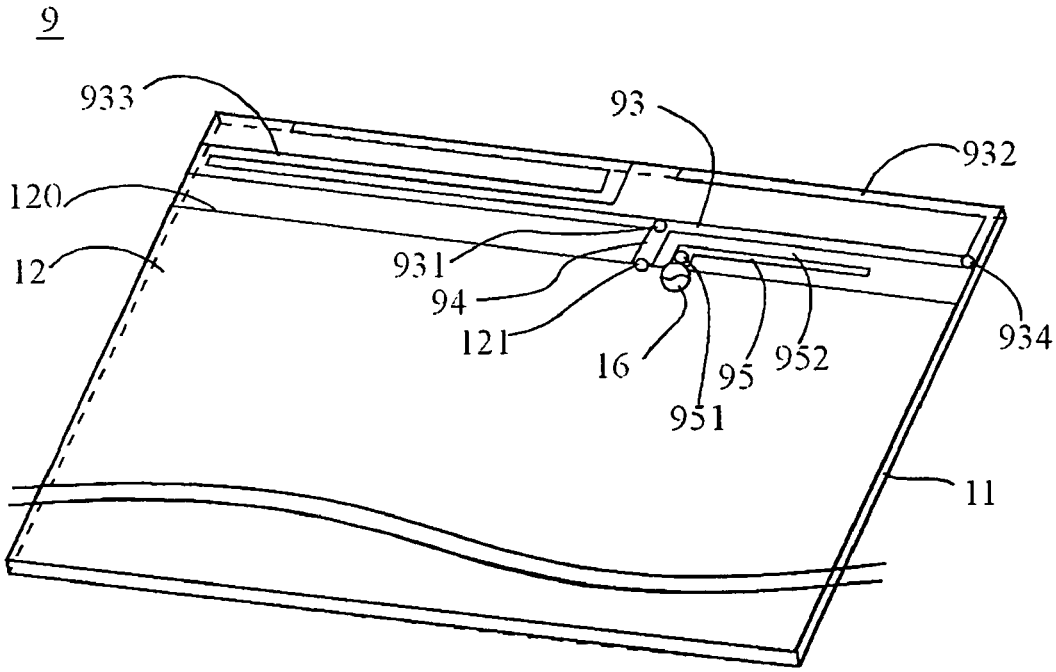
FIG. 9 is a structural drawing of the third embodiment of an antenna in the present invention.

FIG. 9 is a structural drawing of the third embodiment of an antenna of the present invention. The radiating portion 93 is formed by stamping or cutting a metal sheet. Besides, the radiating portion 93 can also be formed on the dielectric substrate 11 by printing or etching, and located on a surface of the dielectric substrate 11. The radiating portion 93 is located near an edge 120 of the ground plane 12, but does not overlap with the ground plane 12. The radiating portion 93 comprises a first metal portion 932 and a second metal portion 933. The first metal portion 932 has at least one bending. The second metal portion 933 has at least one bending and is connected to the first metal portion 932. The shorting metal portion 94 is formed by stamping or cutting a metal sheet as the radiating portion 93, and can also be formed on the dielectric substrate 11 by printing or etching, and located on the same surface with the radiating portion 93. One end of the shorting metal portion 94 is electrically connected to the radiating portion 93, and the other end is connected to the shorting point 121 of the ground plane 12. The feeding metal portion 95 is formed on the dielectric substrate 11 by printing or etching, and located on the same surface with the radiating portion 93. The feeding metal portion 95 has a feeding point 952 serving as the feeding point 952 of the antenna of the present invention. The feeding point 952 is connected to a signal source 16. The feeding metal portion 95 is separated from the radiating portion 93 by a gap 951. The width of the gap 951 can be extended to 3 mm. In this embodiment, the feeding metal portion 95 is directly separated from the radiating portion 93 by the gap 951 to capacitively excite the radiating portion 93. This embodiment can also achieve a result similar to the first embodiment, and satisfies the requirements for mobile communication.

In the above description, the said embodiments are for describing the principles and results of the present invention. These embodiments are not used to restrict the present invention. Therefore, those who are familiar with this art can make some modifications and changes for these embodiments without disobeying the spirits of the present invention. The range of rights of the invention is listed as the claims described in the following pages.

What is claimed is:

1. A coplanar coupled-fed multiband antenna for mobile communication, comprising:

a dielectric substrate;

a ground plane located on a surface of the dielectric substrate and having a shorting point located at one edge of the ground plane, and the edge located in the interior of the dielectric substrate;

a radiating portion located on a surface of the dielectric substrate and near one edge of the ground plane without overlapping with the ground plane, wherein two ends of the radiating portion are both open ends;

a shorting metal portion located on a surface of the dielectric substrate, and located on the surface of the dielectric substrate where the radiating portion is located on, and one end of the shorting metal portion electrically connected to the radiating portion, and the other end of the shorting metal portion connected to the shorting point of the ground plane; and a feeding portion located on the surface of the dielectric substrate where the radiating portion located on, comprising:

a first feeding metal portion having a feeding point being the feeding point of the coplanar coupled-fed multiband antenna, and the feeding point connected to a signal source; and a second feeding metal portion separated from the first feeding metal portion by a gap, and one end of the second feeding metal portion connected to the radiating portion.

2. The coplanar coupled-fed multiband antenna of claim 1, wherein the dielectric substrate is a system circuit board of mobile communication apparatus.

3. The coplanar coupled-fed multiband antenna of claim 1, wherein the radiating portion comprises:

a first metal portion having at least one bending; and a second metal portion having at least one bending and connected to the first metal portion.

4. The coplanar coupled-fed multiband antenna of claim 1, wherein the radiating portion and the shorting metal portion are formed by stamping or cutting a metal sheet.

5. The coplanar coupled-fed multiband antenna of claim 1, wherein the radiating portion, the shorting metal portion and the feeding portion are formed on the dielectric substrate by printing or etching.

6. The coplanar coupled-fed multiband antenna of claim 1, wherein the gap between the second feeding metal portion and the first feeding metal portion is less than 3 mm.

7. The coplanar coupled-fed multiband antenna of claim 1, wherein the radiating portion has at least one bending, so as to make a part of the radiating portion substantially vertical to the ground plane.

8. A coplanar coupled-fed multiband antenna for mobile communication, comprising:

a dielectric substrate;

a ground plane located on a surface of the dielectric substrate and having a shorting point located at an edge of the ground plane, and the edge located in the interior of the dielectric substrate;

a radiating portion located on a surface of the dielectric substrate, and the radiating portion located near one edge of the ground plane without overlapping the ground plane, wherein two ends of the radiating portion are both open ends;

a shorting metal portion located on the surface of the dielectric substrate where the radiating portion is located on, and one end of the shorting metal portion electrically connected to the radiating portion, while the other end of the shorting metal portion electrically connected to the shorting point of the ground plane; and a feeding meal portion located on the surface of the dielectric substrate where the radiating portion is located on, and having a feeding point being the feeding point of the coplanar coupled-fed multiband antenna, wherein the feeding point is connected to a signal source and the feeding metal portion is separated from the radiating portion by a gap.

9. The coplanar coupled-fed multiband antenna of claim 8, wherein the dielectric substrate is a system circuit board of mobile communication apparatus.

10. The coplanar coupled-fed multiband antenna of claim 8, wherein the radiating portion comprises:

a first metal portion having at least one bending; and a second metal portion having at least one bending, and connected to the first metal portion.

11. The coplanar coupled-fed multiband antenna of claim 8, wherein the radiating portion and the shorting metal portion are formed by stamping or cutting a metal sheet.

12. The coplanar coupled-fed multiband antenna of claim 8, wherein the radiating portion, the shorting metal portion and the feeding metal portion are formed on the dielectric substrate by printing or etching.

13. The coplanar coupled-fed multiband antenna of claim 8, wherein the gap between the feeding metal portion and the radiating portion is less than 3 mm.

* * * * *